US005524053A

United States Patent [19]

Iwamatsu

[11] Patent Number: 5,524,053

[45] Date of Patent: Jun. 4, 1996

[54] SOUND FIELD CONTROL DEVICE

[75] Inventor: Masayuki Iwamatsu, Hamamatsu, Japan

[73] Assignee: Yamaha Corporation, Japan

[21] Appl. No.: 204,526

[22] Filed: Mar. 1, 1994

[30] Foreign Application Priority Data

Mar. 5, 1993 [JP] Japan ..... 5-070814

[51] Int. Cl.[6] ..... H04R 5/00

[52] U.S. Cl. ..... 381/18; 381/63; 381/61; 381/17

[58] Field of Search ..... 381/18, 24, 63, 381/61, 17; 84/630, 707, DIG. 26

[56] References Cited

U.S. PATENT DOCUMENTS

| | | | |
|---|---|---|---|
| 3,725,586 | 4/1973 | Jida | 381/18 |
| 3,745,254 | 7/1973 | Ohta | 381/18 |
| 4,308,423 | 12/1981 | Cohen | 381/24 |
| 4,980,914 | 12/1990 | Kunugi | 381/63 |
| 5,105,462 | 4/1992 | Lowe | 381/63 |
| 5,197,100 | 3/1993 | Shiraki | 381/24 |
| 5,371,799 | 12/1994 | Lowe | 381/17 |

FOREIGN PATENT DOCUMENTS

| | | | |
|---|---|---|---|
| 0161800 | 12/1981 | Japan | 381/24 |

*Primary Examiner*—Curtis Kuntz
*Assistant Examiner*—Minsun Oh
*Attorney, Agent, or Firm*—Graham & James

[57] ABSTRACT

A sound field control device for reproducing plural reflected sound signals of a source signal about a listening point includes a reflected sound signal generation section for generating reflected sound signals to be sounded at front left and front right positions of the listening point and a reflected sound signal to be sounded at a rear position of the listening point, a phase shifting circuit for phase shifting the reflected sound signal to be sounded at a rear position and thereby producing a first phase shifted signal and a second phase shifted signal which are different in phase substantially by 180 degrees from each other, a first adder for adding the reflected sound signal to be sounded at a front left position and the first phase shifted signal together, and a second adder for adding the reflected sound signal to be sounded at a front right position and the second phase shifted signal together. Outputs of the first adder and the second adder are used for driving loudspeakers disposed at front left and front right positions of the listening point. A stereophonic sound field rich in presence can be created with only two loudspeakers without using four loudspeakers as in a prior art device.

11 Claims, 7 Drawing Sheets

SOUND FIELD CONTROL DEVICE

BACKGROUND OF THE INVENTION

This invention relates to a sound field control device for imparting a sound field effect in reproduction of a music by an audio device and, more particularly, to a sound field control device capable of creating a stereophonic sound field with only a pair of loudspeakers.

Imparting of a sound field effect to a music reproduced is sometimes required as a high degree function for musical reproduction. The sound field effect herein means an effect which imparts presence to a listener in a narrow listening room as if the listener was listening to the music in a different space such as a concert hall. In the past, the sound field effect was realized by disposing at least four auxiliary loudspeakers about a room where the sound field effect is to be imparted and reproducing reflected sound signals of different directions produced on the basis of a source signal from these auxiliary loudspeakers.

A prior art system for imparting a sound field effect in reproduction of a music is shown in FIG. 2. In the system of FIG. 2, left and right 2-channel source signals L and R provided by a source device 10 are applied to a sound field control device 16 through input terminals 12 and 14. The sound field control device 16 is constructed in the form of a stereophonic pre-main amplifier having sound field effect imparting function and supplies the input source signals to output terminals 24 and 26 connected to main loudspeakers 84 and 86 through a pre-amplifier 18 and power amplifiers 20 and 22.

The source signals L and R are applied also to a reflected sound signal generation section (sound field effect processor) 28. For reproducing, by these four or more loudspeakers disposed about a listening point in a room, a multiplicity of reflected sounds which are produced naturally in a sound space such as a concert hall or a model space simulating such sound space on the basis of reflected sound data obtained in correspondence to each of hypothetical sound source positions of the reflected sounds in such sound space, the reflected sound signal generation section 28 stores impulse response characteristics of reflected sounds to be sounded by these loudspeakers as reflected sound parameters, generates reflected sound signals, i.e., signals of a multiplicity of reflected sounds to sounded by these loudspeakers by subjecting the respective stored reflected sound signal parameters to a convolution operation with a common source signal, and imparts a sound field effect by supplying these reflected sound signals to corresponding ones of the loudspeakers. This sound field effect imparting system is disclosed in detail in U.S. Pat. No. 5,027,687. More specifically, the source signals L and R applied to the reflected sound signal generation section 28 are synthesized to a single channel signal L–R or L+by a mixer 30. The single channel source signal L–R or L+R is converted to a digital signal by an analog-to-digital converter 34 through a low-pass filter 32 which is provided for eliminating an aliasing noise occurring in the analog-to-digital conversion. The digital source signal is then distributed to four channels and supplied to digital filters 36, 38, 40 and 42 of the respective channels for imparting the source signals with frequency characteristics. Source signals provided by the digital filters 36, 38, 40 and 42 are applied to reflected sound generation circuits 44, 46, 48 and 50 of the respective channels.

A read-only memory (ROM) 52 stores, as parameters of various sound field effect modes, reflected sound parameters of different directions in various sound spaces (such as a concert hall, a studio, a jazz club, a church and a karaoke room) which parameters are composed of delay time data and gain data as shown, for example, in FIG. 3. The reflected sound generation circuits 44, 46, 48 and 50 generate reflected sound signals for the source signal for the respective channels by performing a convolution operation with the source signal on the basis of a parameter of selected mode among the reflected sound parameters stored in the ROM 52. The reflected sound signals thus generated are converted to analog signals on a time shared basis by a digital-to-analog converter 54. An output signal of the digital-to-analog converter 54 is distributed to the respective channels and smoothed by low-pass filters 56, 58, 60 and 62 and then delivered out of the reflected sound signal generation section 28 as analog signals. The reflected sound signals of the respective channels, i.e., front left (FL), front right (FR), rear left (RL) and rear right (RR), are supplied to output terminals 72, 74, 76 and 78 connected to auxiliary loudspeakers 88, 86, 92 and 94 through power amplifiers 64, 66, 68 and 70.

Main signals L and R of the left and right channels provided by the sound field control device 16 are supplied to main loudspeakers 84 and 86 disposed in front of a listening point 82 in a listening room 80. The four channel reflected sound signals FL, FR, RL and RR are supplied to the auxiliary loudspeakers 88, 90, 92 and 94 disposed at four corners of the listening room 80. By this arrangement, a listener can enjoy a music reproduced in an acoustic space as if the listener was listening to the music in a real acoustic space.

In the above described prior art sound field control device, at least four loudspeakers are required for imparting a desired sound field effect.

It is an object of the invention to provide a sound field control device capable of imparting a sound field effect with two loudspeakers.

SUMMARY OF THE INVENTION

For achieving the above described object of the invention, a sound field control device for reproducing plural reflected sound signals of a source signal about a listening point comprises a reflected sound signal generation section for generating reflected sound signals to be sounded at front left and front right positions of the listening point and a reflected sound signal or signals to be sounded at a rear position or positions of the listening point, a phase shifting section for phase shifting the reflected sound signal or signals to be sounded at a rear position or positions in such a manner that the phase of said reflected sound signal or signals is changed in accordance with a frequency thereof and thereby producing a first phase shifted signal and a second phase shifted signal which are different in phase substantially by a 180 degrees from each other, a first addition circuit for adding one of the reflected sound signals to be sounded at a front left position and a front right position to the first phase shifted signal, and outputs of the first and second phase shifted signals, one of which the front left or right reflected sound signal is added to, being used for driving loudspeakers disposed at front left and front right positions of the listening point.

According to the invention, reflected sounds to be sounded at front left and front right positions are actually sounded at the front left and front right positions and, therefore, these reflected sounds are correctly localized at these front positions and a sound field effect before the listening point can be created. Further, reflected sounds to be sounded at rear positions are sounded at the front left and front right positions in the form of reflected sounds which are opposite in phase to each other and, in this case, there occurs a localization in the head which is a phenomenon according to which a listener feels a sound image existing about his head. Owing to this localization effect, the listener feels as if there existed a sound field behind the listening point whereby not only a sound field effect in the front positions but also a sound field effect in the rear positions can be provided with only the two front channels.

In this case, if the reflected sounds which are opposite in phase to each other were sounded clearly, such reflected sounds would give an unpleasant acoustic impression but, actually, these reflected sounds of opposite phases are masked by the reflected sounds which are correctly localized in the front positions to such a degree that the reflected sounds of opposite phases are not clearly sounded and creation of an unpleasant acoustic impression is avoided. Thus, a stereophonic sound field effect which gives a natural acoustic impression can be imparted.

Further, by generating reflected sounds by performing a convolution operation employing impulse response characteristics based on a hypothetical sound source distribution, sound fields simulating various actual sound fields can be realized with loudspeakers disposed at front left and front right positions and, therefore, presence can be improved in audio reproduction by ordinary type cassette decks including a radio, electronic musical instruments and game machines which respectively have a pair of loudspeakers.

Preferred embodiments of the sound field control device according to the invention will be described below with reference to the accompanying drawings.

DESCRIPTION OF PREFERRED EMBODIMENTS

Figure 1:
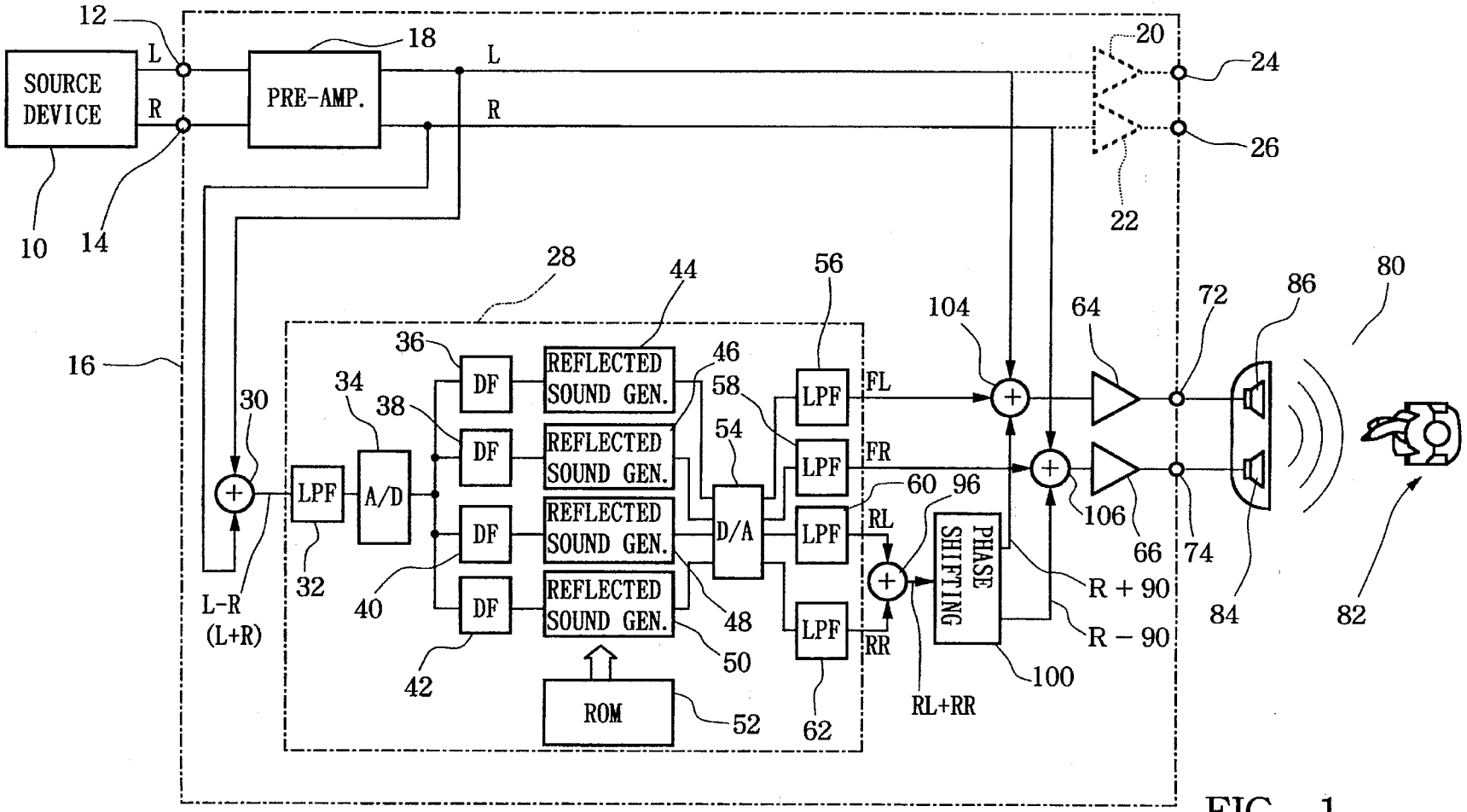
FIG. 1 is a block diagram showing an embodiment of the sound field control device made according to the invention.
Figure 2:
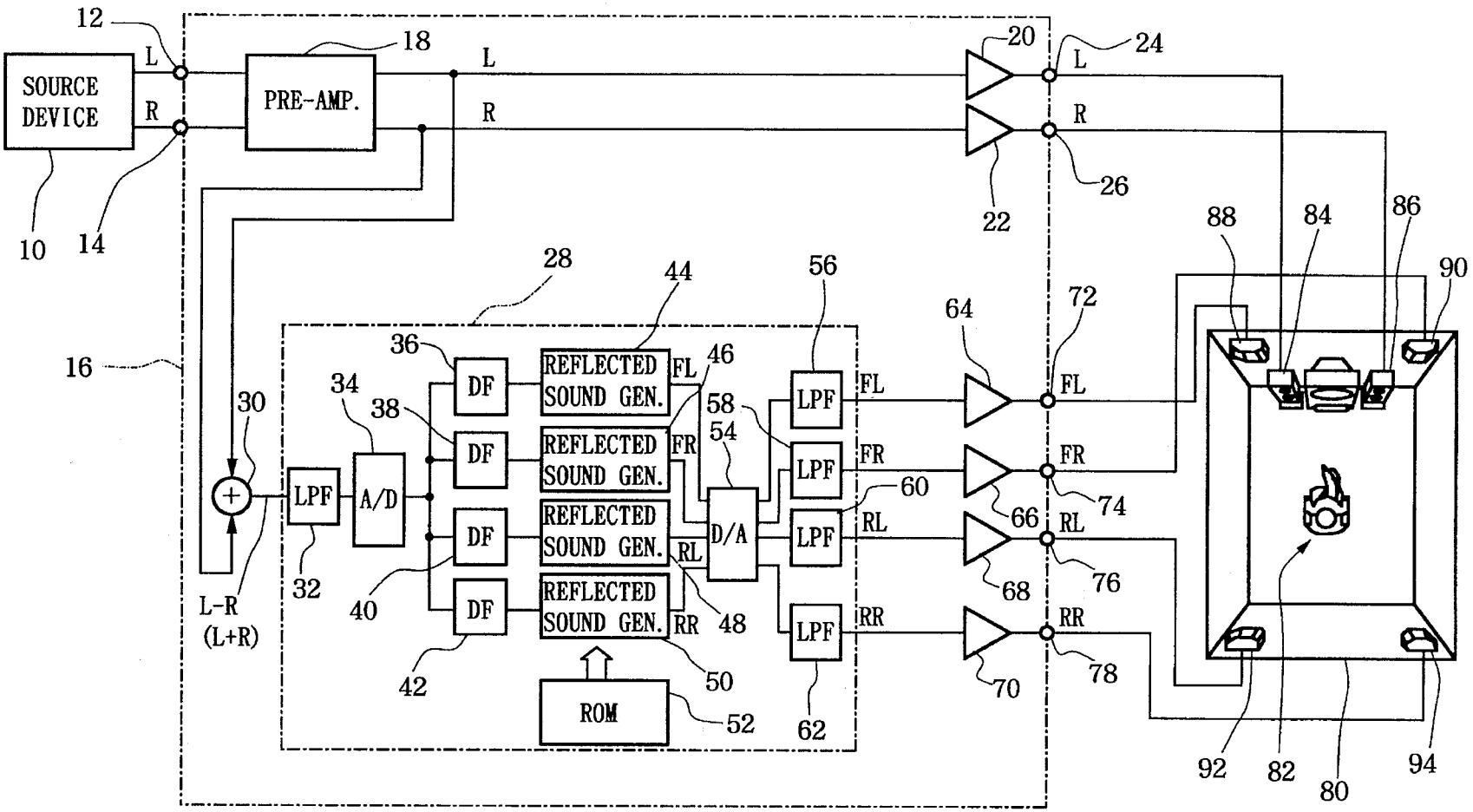
FIG. 2 PRIOR ART
FIG. 2 is a block diagram showing a prior art sound field control device.

Referring to FIG. 1, a first embodiment of the invention will be described. In this embodiment, generation of reflected sounds is made by performing a convolution operation using impulse response characteristics based on a hypothetical sound source distribution in the same the manner as in the prior art device shown in FIG. 2. The system of FIG. 1 can be constructed with a single device such as a 2-loudspeaker type cassette deck having a radio.

Left and right source signals L and R supplied from a source device 10 are applied to a sound field control device 16 through input terminals 12 and 14. The sound field control device 16 is constructed as a pre-main amplifier having a sound field effect imparting function and the input source signals L and R are supplied to a reflected sound signal generation section (sound field effect processor) 28 through a pre-amplifier 18 and a mixer 30. The source signals L and R are synthesized to a single channel signal L–R or L+R by the mixer 30. The single channel source signal is supplied to a low-pass filter 32 for having an aliasing noise occurring in analog-to-digital conversion eliminated and thereafter is converted to a digital signal by an analog-to-digital converter 34. The digital source signal is then distributed to digital filters 36, 38, 40 and 42 of four channels for imparting the source signals with frequency characteristics. Source signals provided by the digital filters 36, 38, 40 and 42 are applied to reflected sound generation circuits 44, 46, 48 and 50 of the respective channels.

Figure 3:
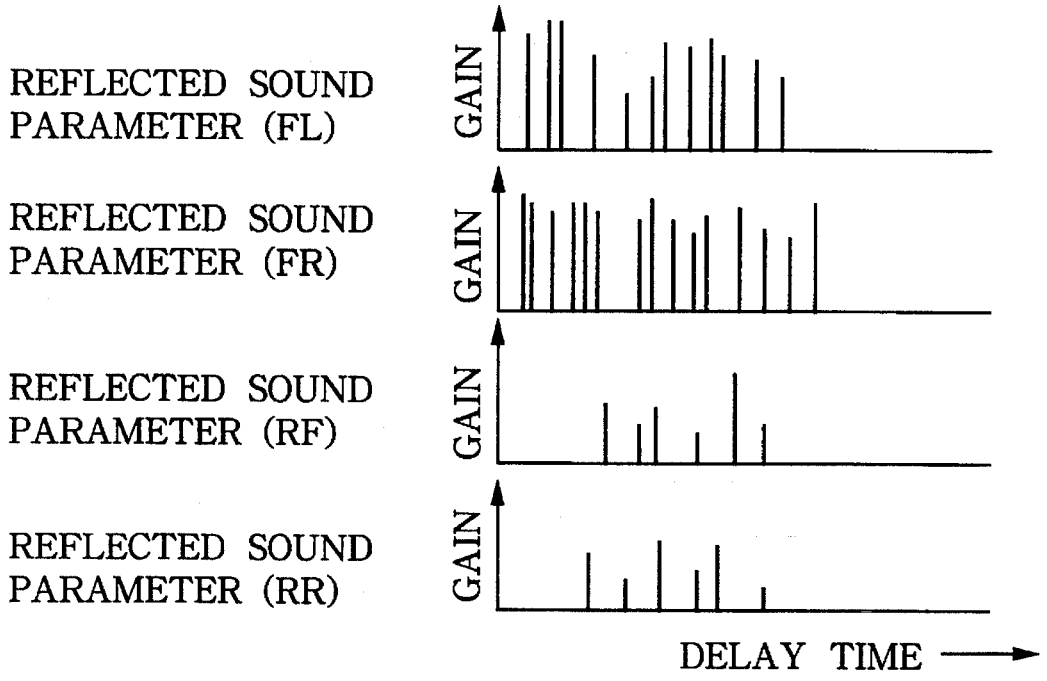
FIG. 3 PRIOR ART
FIG. 3 is a diagram showing an example of reflected sound parameters stored in the ROMs 52 of FIGS. 1 and 2.

A read-only memory (ROM) 52 stores, as parameters of various sound field effect modes, reflected sound parameters of different directions in various sound spaces (such as a concert hall, a studio, a jazz club, a church and a karaoke room) which parameters are composed of delay time data and gain data as shown, for example, in FIG. 3. The reflected sound generation circuits 44, 46, 48 and 50 generate reflected sound signals for the source signal for the respective channels by performing a convolution operation with the source signal on the basis of a selected mode among the reflected sound parameters stored in the ROM 52. The reflected sound signals thus generated are converted to analog signals on a time shared basis by a digital-to-analog converter 54. An output signal of the digital-to-analog converter 54 is distributed to the respective channels and smoothed by low-pass filters 56, 58, 60 and 62 and then delivered out of the reflected sound signal generation section 28 as analog signals.

The rear left and rear right reflected sound signals RL and RR among the reflected sound signals of four directions are added together by an adder 96 and a sum signal is applied to a phase shifting circuit 100. In the phase shifting circuit 100, the sum signal is phase shifted by +90 degrees and –90 degrees to provide two phase shifted signals R+90 and R–90 which are different in phase by substantially 180 degrees from each other and of about the same level. These phase shifted signals R+90 and R–90 are respectively added to the front left and front right reflected sound signals FL and FR by adders 104 and 106. In the adders 104 and 106, the left and right source signals L and R (main signals) are also added. Outputs of the adders 104 and 106 are supplied through power amplifiers 64 and 66 to output terminals 72 and 74 connected to loudspeakers 86 and 84. The left and right channel signals supplied to the output terminals 24 and 26 are supplied to the loudspeakers 84 and 86 (i.e., loudspeakers of the cassette deer having a radio) disposed in front of a listening point 82 in a listening room 80. By this arrangement, the main signals and the reflected sound signals are both reproduced by the loudspeakers 84 and 86. The main signals (direct sounds) are correctly localized in the front positions. The reflected sound signals FL and FR which are to be sounded at the front left and front right positions are also reproduced at the front left and front right positions and, therefore, these reflected sound signals FL and FR are correctly localized at the front positions whereby a sound field effect is produced in front of the listening point 82.

The reflected sound signal RL+RR which is to be sounded in the rear is reproduced at the front left and front right positions as the two reflected sound signals R+90 and R–90 which are opposite in phase to each other. A localization in the head is thereby created and a sound field effect simulating one produced in the rear is produced. Thus, a sound field effect in the rear can be obtained with the loudspeakers 84 and 86 only. The reflected sounds by the reflected sound signals R+90 and R–90 of opposite phases are masked by the front left and front right reflected sounds which are correctly localized to such a degree that these reflected sound of opposite phases are not clearly sounded and creation of an unpleasant acoustic impression is avoided. A sound field effect of a natural acoustic impression is thereby produced. Since generation of the reflected sounds is made by performing a convolution operation using impulse response characteristics based on a hypothetical sound source distribution, sound field effects simulating various actual sound field effects can be produced with the two front loudspeakers 84 and 86 only. Further, since generation of the reflected sounds is made by the convolution operation using the impulse response characteristics based on the hypothetical sound source distribution, as will be apparent from FIG. 3, arrival of the front reflected sounds precedes arrival of the rear reflected sounds. Human hearing is influenced to a larger extent by the front reflected sounds which arrives earlier than by the rear reflected sounds whereby an unpleasant acoustic impression due to the rear reflected sounds is further reduced and imparting of a sound field effect of a natural acoustic impression is further enhanced.

As shown by broken lines in FIG. 1, power amplifiers 20 and 22 and output terminals 24 and 26 for the main signals may be provided on transmission lines of the main signals. Additional loudspeakers (not shown) may be connected to these output terminals 24 and 26 so that the main signals may be sounded by these loudspeakers. In this case, supply of the main signals to the adders 104 and 106 may be stopped by switches (not shown) or the like means.

Figure 4:
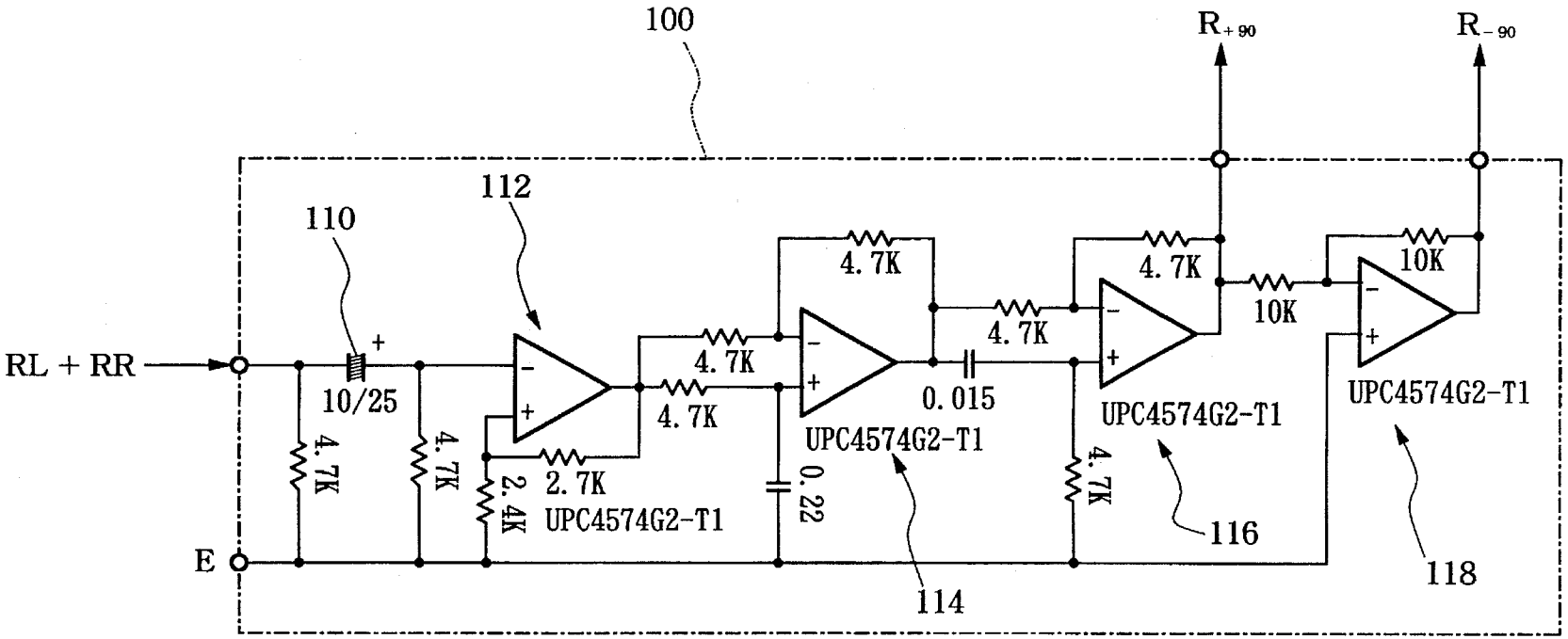
FIG. 4 is a circuit diagram showing a specific example of a phase shifting circuit 100 of FIG. 1.

A specific example of the phase shifting circuit 100 is shown in FIG. 4. In this circuit, the signal RL+RR which is the sum signal of the rear left and rear right reflected sound signals RL and RR is removed of its dc content by a capacitor 110 and then is phase shifted by 90 degrees by a phase shifter 114 through an inverting amplifier 112. The signal RL+RR is further inverted sequentially by inverting amplifiers 116 and 118 and the two phase shifted signals R+90 and R–90 which are different in phase by about 180 degrees are thereby produced.

Figure 5:
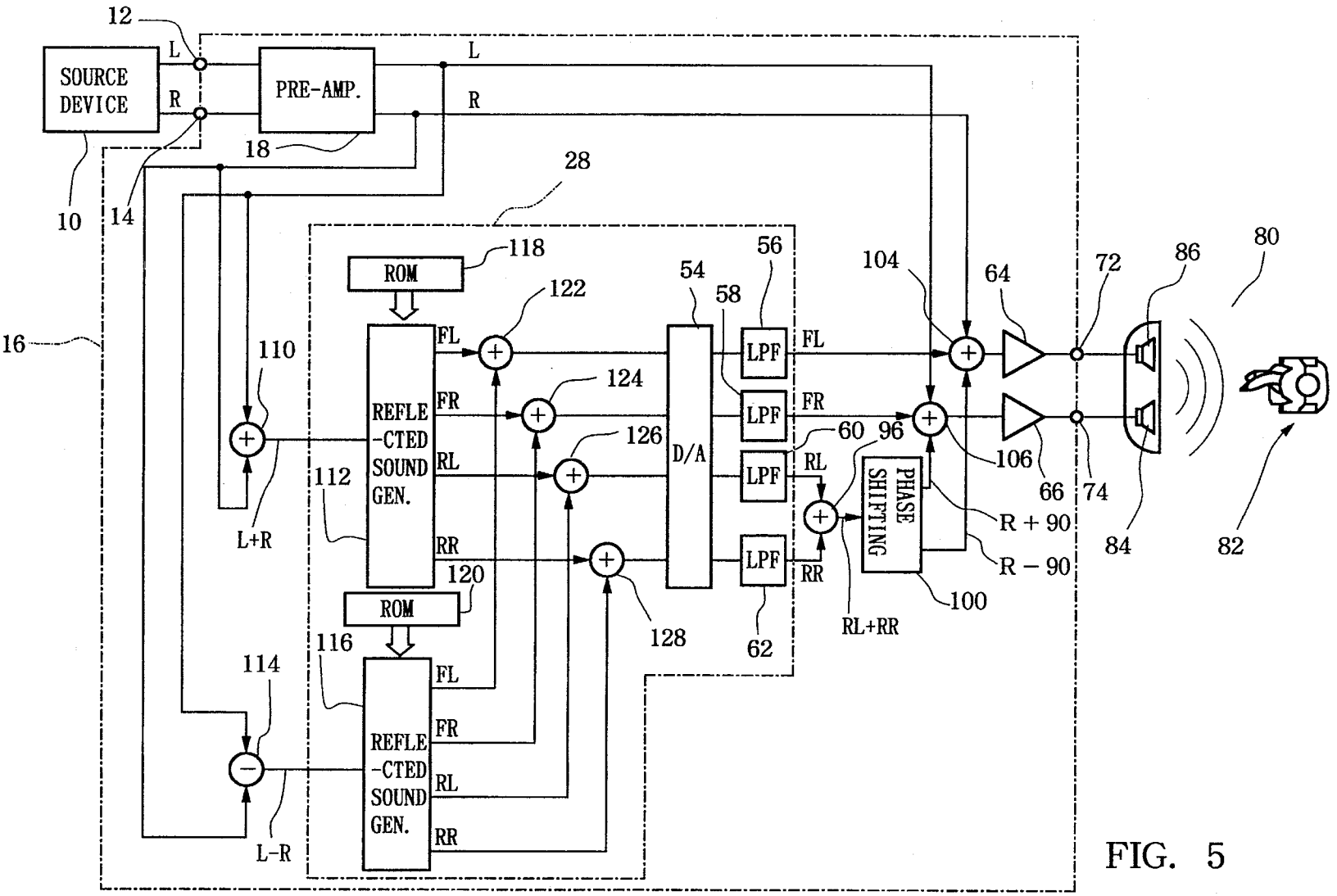
FIG. 5 is a block diagram showing another embodiment of the sound field control device made according to the invention.

FIG. 5 shows a second embodiment of the invention. This embodiment is one in which the present invention applied to a sound field control device disclosed in the Japanese Patent Application Laid-open publication No. Hei 1-115300 in which reflected sound signals are generated by applying different reflected sound parameters to a sum signal L+R and a difference signal L–R of main signals L and R.

In this embodiment, an adder 110 produces a sum signal L+R of the main signals L and R and supplies this sum signal L+R to a reflected sound generation section 112. A subtractor 114 produces a difference signal L–R between the main signals L and R and supplies this difference signal L–R to a reflected sound generation section 116. Each of the reflected sound generation sections 112 and 116 is constructed of the LPF 32, analog-to-digital converter 34, digital filters 36, 38, 40 and 42 and reflected sound generation circuits 44, 46, 48 and 50 shown in FIG. 1. The reflected sound generation sections 112 and 116 generate reflected sounds by performing a convolution operation using reflected sound parameters stored in ROMS 118 and 120. Since the sum signal L+R is a central localizing content of a sound such as conversation, a parameter of a pattern which imparts a sound field of a relatively narrow extent is chosen as the reflected sound parameter for this sum signal L+R. As regards the difference signal L–R, since the difference signal L–R is a non-central localizing content, a parameter of a pattern which imparts a sound field of a relatively broad extent is chosen as the reflected sound parameter for the difference signal L–R.

Reflected sound signals of the same channel provided by the reflected sound generation sections 112 and 116 are added together by adders 122, 124, 126 and 128 and sum signals are converted to analog signals by a digital-to-analog converter 54 on a time shared basis. Output signals of the digital-to-analog converter 54 are distributed to the respective channels and smoothed by low-pass filters 56, 58, 60 and 62 and then are delivered out of a reflected sound signal generation section 28.

The rear left and rear right reflected sound signals RL and RR among the reflected sound signals of four directions are added together by an adder 96 and a sum signal provided by the adder 96 is phase shifted by +90 degrees and –90 degrees by a phase shifting circuit 100 to provide two phase shifted signals R+90 and R–90 which are different in phase by substantially 180 degrees and of about the same level. These phase shifted signals R+90 and R–90 are added to the front left and front right reflected sound signals FL and FR by adders 104 and 106. In the adders 104 and 106, the left and right source signals L and R (main signals) are further added and sum signals from the adders 104 and 106 are supplied to output terminals 72 and 74 through power amplifiers 64 and 66. By this arrangement, the main signals and the reflected sound signals are both sounded from loudspeakers 84 and 86 disposed in front of a listening point 82 in a listening room 80. By employing two different kinds of reflected sound parameters, a proper sound field effect with respect to a central localizing content in sound such as conversation can be realized while providing an impression of broad extent to a non-central localizing content of the sound.

Figure 6:
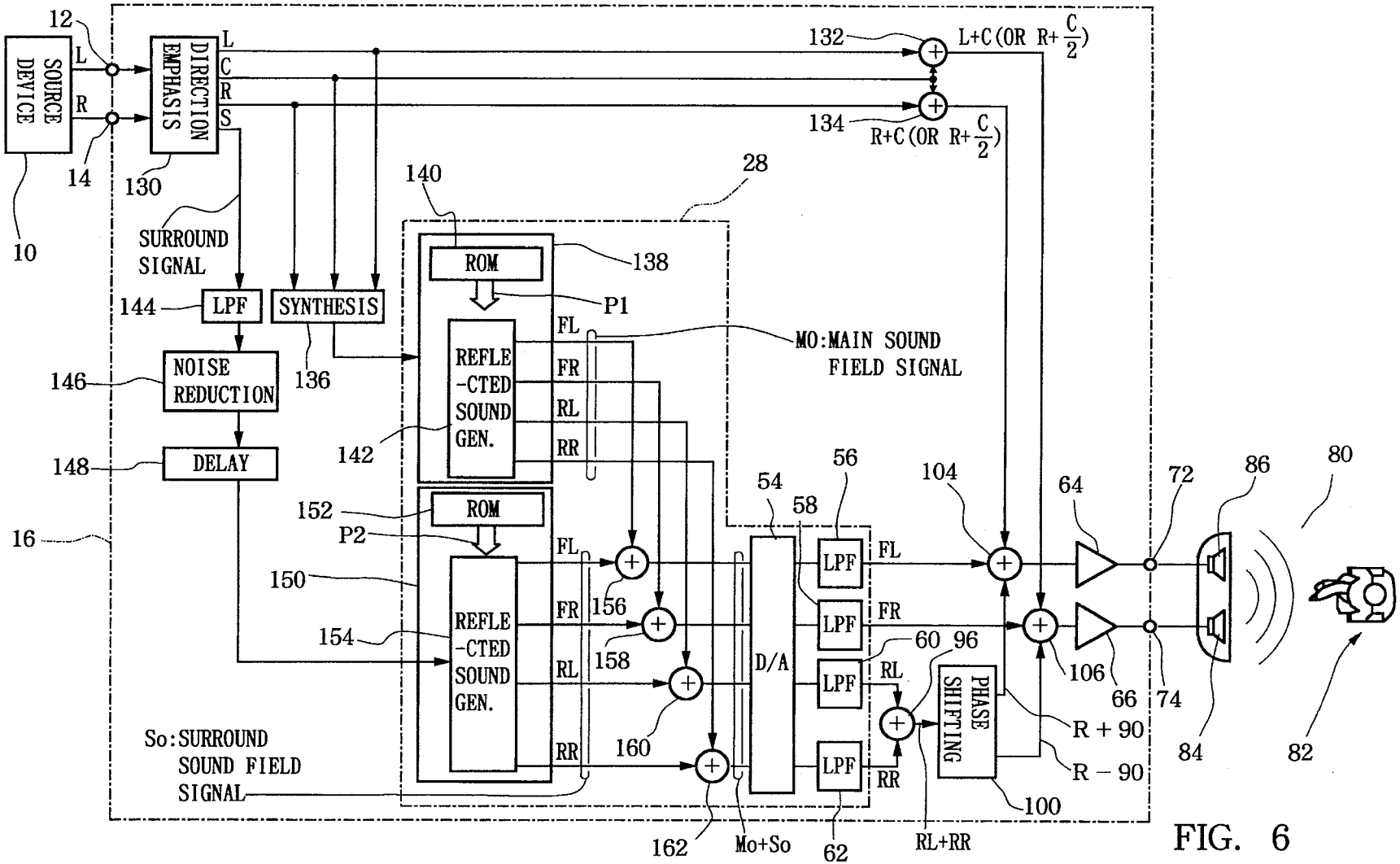
FIG. 6 is a block diagram showing another embodiment of the sound field control device made according to the invention.

FIG. 6 shows a third embodiment of the invention. This embodiment is one in which the present invention is applied to a sound field control device as disclosed in Japanese Patent Application Laid-open No. Hei 4-150200 (U.S. counterpart patent number is U.S. Pat. No. 5,261,005) which imparts a surroundphonic sound effect according to which a listener feels as if he was surrounded by reflected sounds in a 70 mm film movie theater.

Reproduced signals from a Dolby Surround (trademark) encoded laser vision disc (LV) player or a video tape recorder (VTR) are applied as left and right source signals L and R from a source device 10 to input terminals 12 and 14. A direction emphasis circuit 130 judges priority of levels between input signals L and R and also between L+R and L–R and controls levels of respective channels according to result of the judgement and provides four channel signals L, C, R and S through a matrix circuit.

Among these four channel signals, the signals L and C are applied to an adder 132 to produce a signal L+C (or L+C/2). The signals R and C are applied to an adder 134 to produce a signal R+C (or R+C/2).

The signals L, R and C are added together by a synthesizing circuit 136 to produce a main signal M. The main signal M is supplied to a main sound field signal generation section 138. The main sound field signal generation section 138 performs a convolution operation using a reflected sound parameter P1 read from a ROM 140 to produce a reflected sound signal M0 which imparts a first sound field for the main signal M.

For realizing an atmosphere of a 70 mm film movie theater, a reflected sound parameter of a relatively tight sound field which is localized on a front screen side and in which effect sounds and music expand rearwardly of the screen is considered proper as the reflected sound parameter P1. A sound field generation circuit 142 is constructed, for example, of the LPF 32, analog-to-digital converter 34, digital filters 36, 38, 40 and 42 and reflected sound generation circuits 44, 46, 48 and 50 of FIG. 1 and generates the reflected sound signal M0 (i.e., the main sound field signal) by the convolution operation using the reflected sound parameter P1 stored in the ROM 140.

The surround signal S provided by the direction emphasis circuit 130 is supplied to a surround sound field signal generation section 150 through a low-pass filter 144 of 7 kHz, a modified Dolby B noise reduction circuit 146 and a delay circuit 148 of 15 mmsec to 30 mmsec.

The surround sound field signal generation section 150 generates a reflected sound signal S0 (surround sound field signal) which imparts a second sound field for the surround signal S by performing a convolution operation using a reflected sound parameter P2 read from a ROM 152 and includes a reflected sound generation section 154 which is of a similar structure to the reflected sound generation section 142 of the main sound field signal generation section 138. For realizing an atmosphere of a 70 mm film movie theater, a reflected sound parameter which imparts a broad sound field localized in a manner to surround a listener as a surround sound field is suited as the reflected sound parameter P2.

The main sound field signal M0 generated by the main sound field signal generation section 138 and the surround sound field signal S0 generated by the surround sound field generation section 150 are supplied to adders 156, 158, 160 and 162 and signals of corresponding channels of these sound field signals M0 and S0 are added together by these adders 156, 158, 160 and 162. A synthesized reflected sound field signal M0+S0 is converted to an analog signal on a time shared basis by a digital-to-analog converter 54. An output of the digital-to-analog converter 54 is distributed to the respective channels and smoothed by low-pass filters 56, 58, 60 and 62 and delivered out of the reflected sound signal generation section 28.

Among the reflected sound signals of four directions, the rear left and rear right reflected signals RL and RR are added together by an adder 96 and a sum signal from the adder 96 is phase shifted by +90 degrees and −90 degrees by a phase shifting circuit 100 to produce two phase shifted signals which are different in phase by substantially 180 degrees from each other and of about the same level. These phase shifted signals R+90 and R−90 are added to the front left and front right reflected sound signals FL and FR by adders 104 and 106. Further, in the adders 104 and 106, the left and right source signals L and R (main signals) are added. Sum signals from the adders 104 and 106 are supplied to output terminals 72 and 74 connected to loudspeakers 86 and 84 disposed in front of a listening point 82 in a listening room 80 through power amplifiers 64 and 66. By this arrangement, the main signals and the reflected sound signals are both reproduced from the loudspeakers 86 and 84 whereby a listener can enjoy contents of a laser vision disc or the like in an atmosphere of a 70 mm film movie theater.

Figure 7:
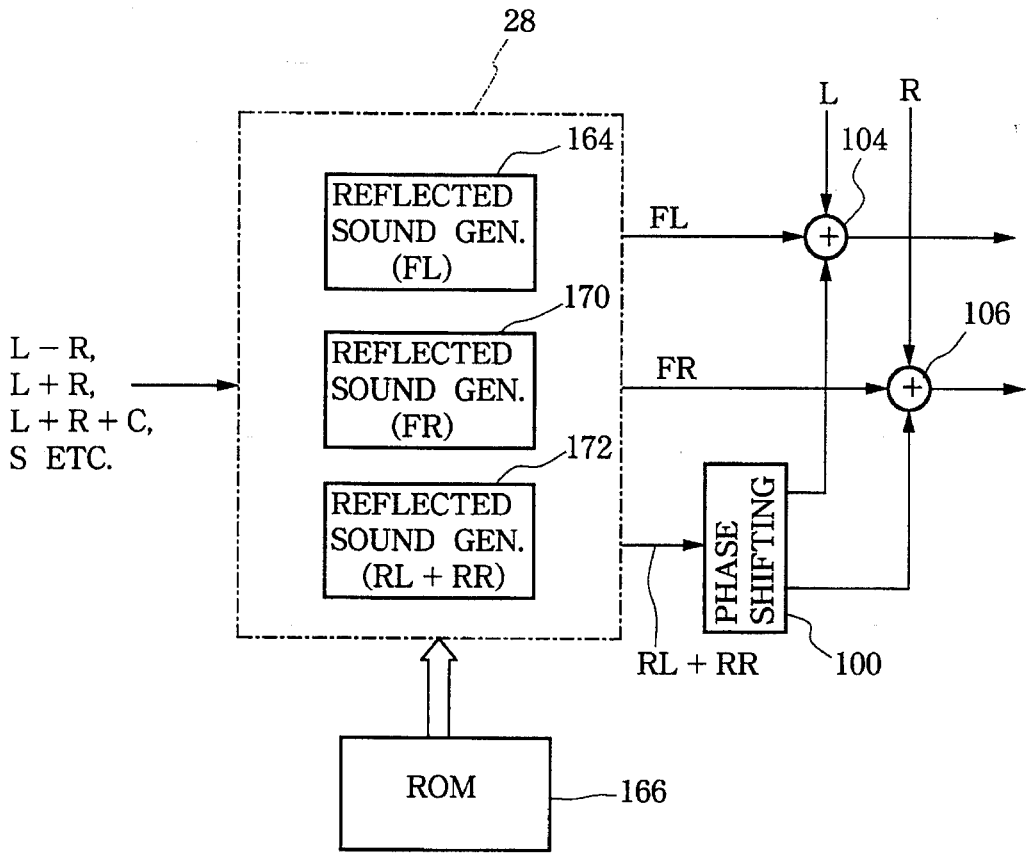
FIG. 7 is a block diagram showing a modified example of the reflected sound generation section.
Figure 8:
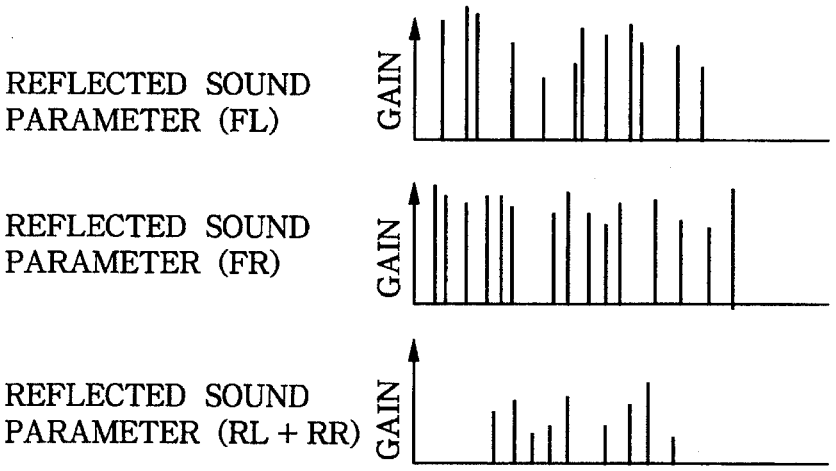
FIG. 8 is a diagram showing an example of reflected sound parameters stored in a ROM 166 of FIG. 7.

In the above described embodiments, parameters of four directions, i.e., front left, front right, rear left and rear right, are employed as the reflected sound parameters. Alternatively, as shown in FIG. 8, a reflected sound parameter of RL+RR may be prestored for rear reflected sound in a ROM 166 of a circuit shown in FIG. 7. By this arrangement, only three reflected sound generation circuits 168 for FL, 170 for FR and 172 for RL+RR are required so that the circuit design can be simplified.

In the above described embodiments, the rear left and rear light reflected sound signals are added together before being phase shifted. Alternatively, a reflected sound parameter for a reflected sound signal which is to be sounded at a rear central position may be generated and used independently from the rear left and rear right reflected signals.

In the above described embodiments, reflected sounds are generated by a convolution operation using impulse response characteristics based on a hypothetical sound source distribution. The scope of the invention is not limited to this but various other reflected sound signal generation systems may be employed for generating reflected sound signals for source signals to be sounded at front left and front right positions of a listening point and a reflected sound signal for the source signals to be sounded in the rear of the listening point.

Further, only one of the front left and front right reflected sound signals FL and FR may be added to each phase shifted signal and the sum signals may be supplied to either one of the front left and front right loudspeakers.

What is claimed is:

1. A sound field control device for reproducing plural reflected sound signals of a source signal about a listening point comprising:

reflected sound signal generation means for generating at least one reflected sound signal to be sounded at front left and front right positions about the listening point and for generating at least one rear reflected sound signal to be sounded at least one rear position about the listening point;

phase shifting means for phase shifting said at least one rear reflected sound signal in such a manner that the phase of said rear reflected sound signal is changed in accordance with a frequency thereof to produce a first phase shifted signal and a second phase shifted signal which are different in phase substantially by 180 degrees from each other;

first addition means for adding one of the reflected sound signals to be sounded at a front left or front right position to the first phase shifted signal to produce a first combined signal, wherein said first combined signal and said second phase shifted signal are used for driving loudspeakers disposed at front left and front right positions about the listening point.

2. A sound field control device as defined in claim 1, wherein the first addition means adds the front left reflected sound signal and the first phase shifted signal together to provide said first combined signal, the device further comprising:

second addition means for adding the front right reflected sound signal and the second phase shifted signal together to form a second combined signal, wherein said first combined signal and said second combined signal are used for driving loudspeakers disposed at front left and front right positions of the listening point.

3. A sound field control device as defined in claim 1 wherein said reflected sound signal generation means generates, for reproducing plural reflected sounds about the listening point in an acoustic space or a model space simulating the acoustic space on the basis of reflected sound data obtained in correspondence to hypothetical sound source positions of the reflected sounds in the acoustic space, reflected sound signals to be sounded at front left and front right positions about the listening point and a sum signal of reflected sound signals to be sounded at rear left and rear right positions about the listening point by a convolution operation of the source signal with respect to impulse response characteristics of reflected sounds to be sounded at the front left and front right positions and the rear left and rear right positions about the listening point.

4. A sound field control device as defined in claim 2 where i n said first addition means adds at least the left signal in the source signal, the front left reflected sound signal in the reflected sound signals and the first phase shifted signal in the outputs of said phase shifting means together and said second addition means adds at least the right signal in the source signal, the front right reflected sound signal in the reflected sound signals and the second phase shifted signal in the outputs of said phase shifting means together.

5. A sound field control device as defined in claim 3 wherein said reflected sound signal generation means comprises storage means for prestoring four reflected sound parameters for front left, front right, rear left and rear right positions to be used for the convolution operation.

6. A sound field control device as defined in claim 3 wherein said reflected sound signal generation means comprises storage means for prestoring two reflected sound parameters for front left and front right positions and a sum reflected sound parameter for rear left and rear right positions to be used for the convolution operation.

7. A sound field control device as defined in claim 1 wherein said reflected sound signal generation means generates, for reproducing plural reflected sounds about the listening point in an acoustic space or a model space simulating the acoustic space on the basis of reflected sound data obtained in correspondence to hypothetical sound source positions of the reflected sounds in the acoustic space, reflected sound signals to be sounded at front left and front right positions of the listening point and a reflected sound signal to be sounded at a rear position of the listening point by a convolution operation of the source signal with respect to impulse response characteristics of reflected sounds to be sounded at the front left and front right positions and a rear central position of the listening point.

8. A sound field control device for reproducing plural reflected sound signals of a source signal about a listening point comprising:

reflected sound signal generation means for generating at least one front reflected sound signal to be sounded at a front left position and a front right position about the listening point and for generating a rear reflected sound signal;

phase shifting means for phase shifting the rear reflected sound signal in such a manner that the phase of said rear reflected sound signal is changed to produce a first phase shifted rear reflected sound signal and a second phase shifted rear reflected sound signal which are different in phase substantially by 180 degrees from each other;

first addition means for adding the front reflected sound signal to be sounded at the front left position to the first phase shifted rear reflected sound signal;

second addition means for adding the front reflected sound signal to be sounded at the front right position to the second phase shifted rear reflected sound signal, wherein the outputs of the first addition means and the second addition means are used to drive loudspeakers disposed at front left and front right positions about the listening point.

9. A sound field control device as defined in claim 8 wherein said at least one front reflected sound signal comprises distinct front left reflected sound signal and front right reflected sound signal, and said first addition means adds the front left reflected sound signal to the first phase shifted rear reflected sound signal, and said second addition means adds the front right reflected sound signal to the second phase shifted rear reflected sound signal.

10. A sound field control device as defined in claim 8 wherein said at least one front reflected sound signal comprises a single front reflected sound signal to be sounded at a front left position and a front right position about the listening point and for generating a rear reflected sound signal.

11. A sound field control device as defined in claim 8, wherein said reflected sound signal generation means generates a rear left reflected sound signal and a rear right reflected sound signal, and further includes third addition means for adding the rear left reflected sound signal and the rear right reflected sound signal to form the rear reflected sound signal which is applied to the phase shifting means.

* * * * *